US007300551B2

(12) United States Patent
Weinstein et al.

(10) Patent No.: US 7,300,551 B2
(45) Date of Patent: Nov. 27, 2007

(54) PAPER MACHINE BELT CONDITIONING SYSTEM, APPARATUS AND METHOD

(75) Inventors: David I. Weinstein, Hawthorn Woods, IL (US); Peter E. Perry, Winslow, ME (US); James P. Rivard, Cornell, MI (US); Pawel Cirocki, Suchy Dwor (PL)

(73) Assignee: Nalco Company, Naperville, IL (US)

( * ) Notice: Subject to any disclaimer, the term of this patent is extended or adjusted under 35 U.S.C. 154(b) by 369 days.

(21) Appl. No.: 10/792,234

(22) Filed: Mar. 3, 2004

(65) Prior Publication Data

US 2005/0194114 A1 Sep. 8, 2005

(51) Int. Cl.
*D21G 3/00* (2006.01)

(52) U.S. Cl. ..... 162/272; 162/199; 162/274; 162/275

(58) Field of Classification Search ..... 162/199, 162/272, 274, 275
See application file for complete search history.

(56) References Cited

U.S. PATENT DOCUMENTS 3,055,496 A * 9/1962 Dunlap ..... 428/153
4,483,745 A * 11/1984 Wicks et al. ..... 162/205
5,073,235 A * 12/1991 Trokhan ..... 162/199

FOREIGN PATENT DOCUMENTS

WO WO 97/13030 4/1997
WO WO 98/45534 10/1998

* cited by examiner

*Primary Examiner*—Mark Halpern
(74) *Attorney, Agent, or Firm*—Peter A. Dimattia; Michael B. Martin; Thomas M. Breininger

(57) ABSTRACT

A belt conditioning method, apparatus and paper machine employing the method and apparatus are provided. The belt method and apparatus include multiple conditioning devices using chemicals to condition water impermeable surfaces of paper machine belts, such as transfer belts and prevent deposits from accumulating on the belts. In one embodiment, the belt supports a web at a first portion of the belt's loop and is separated from the web at a second portion. The conditioning apparatuses are placed in the second portion.

22 Claims, 2 Drawing Sheets

PAPER MACHINE BELT CONDITIONING SYSTEM, APPARATUS AND METHOD

BACKGROUND OF THE INVENTION

The present invention relates to conveying systems and more particularly to the cleaning or conditioning of impermeable belts that operate with paper conveying systems.

During a papermaking process, a slurry is placed on a forming fabric or press fabric to form a fibrous web of cellulosic fibers at a forming section of a paper machine. Water is drained from the slurry in the forming section to form on the press fabric a fibrous web that includes paper fibers from the slurry. The newly formed web is then conducted to a press section. The press section includes a series of press nips. The press nips subject the fibrous web to compressive forces. Those forces are applied to further remove water from the web by pressing the water into the press fabric, which absorbs and holds the water. The web is then conducted to a drying section, which typically employs drying drums around which the fibrous web is conveyed. The drying drums also reduce the water content of the web to a final desirable level through evaporation, yielding a paper product that can be cut or otherwise processed and packaged.

It is desirable to remove as much water from the web as possible through mechanical processes, such as via the press rolls. The drying sections consume a large amount of energy. The dryer drums are in many cases heated from within by steam. Energy costs associated with steam production can be substantial and provide one factor mitigating against extensive use of the drying section. Attempts have therefore been made recently to remove as much water as possible through mechanical pressing as opposed to evaporation.

Traditional press sections have included a series of nips formed by pairs of adjacent cylindrical press rolls. Increased demand has mandated that the paper machines be run at higher speeds, including increased web speeds. Increasing the web speed however decreases the amount of time that the web spends between the press nips, tending to render press drying less effective. While the pressure applied by the press nips can be increased, there are limits to the amount of pressure that the fibrous or paper web can be subjected.

One solution to the above-described dilemma in recent years has been to use longer press nips, one type of which is known as a "shoe" type of press nip. The longer shoe press nips are advantageous with respect to paired nip rolls because the longer press nips subject the web to pressure for a longer duration and thus remove more water from the web. Consequently, less water remains to be removed through evaporation in the dryer section.

Shoe type press nips include a cylindrical press roll and an arcuate pressure shoe. The shoe has a concave surface with a radius of curvature close to that of the cylindrical press roll. The roll and shoe when brought together form a press nip in which the length of mating surfaces may be five to ten times longer than similar sized cylindrical press roll nips. Since the mating surface length may be five to ten times longer, the so-called dwell time, during which the fibrous web is under pressure in the longer nip, is correspondingly longer that it would be in a two cylindrical roll press. The newer long nip technology has dramatically increased the amount of dewatering caused by the press section of the paper machine.

The long nip presses of the shoe type use a particular belt designed to protect the press fabric that supports, carries and dewaters the fibrous web. Without the belt, the press fabric would be subject to excessive and accelerated wear due to the long dwell time resulting from direct, sliding contact over the stationary pressure shoe. The protective belt is provided with a smooth, impermeable surface or coating that slides over the stationary shoe on a lubricating film of oil. The impermeable belt moves through the nip at roughly the same speed as the press fabric, subjecting the press fabric to a minimal amount of rubbing against the surface of the impermeable belt.

One method of making impermeable conveying belts is to impregnate a synthetic polymeric coating onto or into a woven base fabric formed into an endless loop. The coating typically forms an impermeable layer of some predetermined thickness on at least the surface of the belt contacting the arcuate pressure shoe to protect the woven base fabric from the shoe. The coating has a smooth, impermeable surface that slides readily over the lubricated shoe and prevents any of the lubricating oil between the coating and the shoe from penetrating the structural fabric of the belt and contaminating the press fabric and the fibrous web.

Besides enabling the machines to run faster by increasing the "dwell time" between nip rolls, certain paper machines today are attempting to increase productivity by closing the "draw" between the press section and the drying section. In the past, the paper web was practically fully unsupported for about 1.0 m to 2.0 m in the area between the press and the dryer sections. Such unsupported area of the web became exposed to strong air currents. One reason the draw was necessary was to detach the web from the center roll. The web fluttering in the free, unsupported area was controlled by arranging a high difference in speed in the area between opposing rolls to thereby pull the web tighter.

The closed draw concept was developed to address a problem, namely, that the paper web was tensioned highly at its weakest point, the unsupported area between the press and dryer sections. In the closed draw concept, the dryer fabric is brought as near to the press section as possible. By minimizing the length of the free, unsupported web transfer from the press section to the first dryer, the fluttering of the web can be significantly reduced or eliminated totally. The formerly needed high-speed differential is now significantly reduced because the remaining draw is merely needed to pull the web off the press roll surface.

As modern high-speed paper machines approach speeds of 1900 meters per minute, increasing the force needed to release the sheet from the press section, the tension in the web in the open draw section will be further increased. At some point the web will not be able to withstand the forces imposed. Consequently, the closed draw concept appears to be important for the future of high-speed paper machines.

New press section designs, such as the Valmet OptiPress® from Metso Paper provide total sheet support with no open draws. That system however, especially when run with four felts, can lead to a significant amount of rewet caused by moisture being conveyed back to the web by saturated felts. To reduce rewet and improve sheet handling, one of the bottom press felts can be replaced with a non-porous, water impermeable transfer fabric. One such belt is a TransBelt® belt from Albany International Corp., Albany N.Y. That belt includes a woven substrate and a multi-component polymer layer placed onto the paper or face side of the belt. The polymer coating is well-suited at adhering and then releasing from the web at high speeds.

The discussion above describes two instances where the press fabric has been coated with a water impermeable coating, such as a polymer coating. In the first instance, for operating with the arcuate pressure shoe, the coating is applied to non-paper or back-side of the belt as installed. In the second instance, for reducing rewetting in a closed draw system, the coating is applied to the paper or face-side of the belt as installed in the paper machine.

Because the above-described water impermeable belts for the above-described systems are relatively new, not much is known about the conditioning needed for such belts. Typical fabrics used to support the web, such as the wires of the wet end and the dry end of the web and the felts of the press section, will absorb fiber material and impurities that gradually block the fabric and prevent water from migrating through the fabric, if the fabric is not cleaned from time to time. Conditioning devices have therefore been used with water permeable fabrics, for example, in the fabric return loop in to clean the fabric as it passes over the guide roll or in the fabric return loop to clean the fabric as it passes over the guide roll or similar apparatus.

To date, it does not appear that water impermeable belts have been cleaned using chemical solutions. Published PCT application WO 98/45534 (PCT/F198/00288) discusses a transfer belt which is "water non-receiving" and that withstands intensive cleaning, for example, by high-pressure water jets or doctors. Further, literature for the TransBelt® belt states that light doctoring and a fan lubrication shower on the surface of the TransBelt® belt are all that is required to maintain a good working condition of the surface.

The inventors of the present invention believe that impermeable belts accumulate enough deposits to warrant chemical conditioning. The present invention addresses that need.

SUMMARY OF THE INVENTION

The present invention provides an apparatus, method and paper machine using such apparatus and method that chemically conditions water impermeable belts, removing deposits (referring herein additionally to debris, dirt and chemical residue) accumulating on the belt and preventing deposits from accumulating on the belt. In one embodiment, the chemicals are applied to an impermeable surface located on the face-side of the belt. In this embodiment, the apparatus of the present invention can operate with newer type press sections that provide total sheet support with no open draws. Those press sections typically consist of two straight-through presses, with one or both being a shoe press. That configuration can lead to a significant level or rewet. To reduce rewet and improve sheet handling, the second bottom press felt is replaced with a water impermeable, flexible transfer fabric. The conditioning apparatus of the present invention conditions the face-side of the water impermeable, flexible transfer fabric.

The apparatus can include, initially, a face-side driven roll such as a felt roll, which acts as a pre-cleaner to remove bigger or looser deposits and reduce the load on the chemical washers. The roll is driven in one embodiment at a substantially slower speed relative to the transfer belt speed to achieve a desired surface contact friction. The felt roll itself can be conditioned with a doctor blade and shower through which a semi-continuous or continuous solution is dosed.

The apparatus includes at least one chemical shower positioned in proximity to a face-side roll that contacts the transfer belt. The shower can be an oscillating fan shower, which directs spray over the entire width of the belt. In one embodiment, the spray is aimed directly into the roll, where the roll meets the belt. The chemical solutions can be neutral-, acid- or alkaline-based formulations and can be dosed through the shower in a continuous or semi-continuous manner.

In one embodiment a shower, such as a doctor blade shower, is placed at or near at least one of or at or near all face-side rolls that contact the impermeable transfer belt surface. One preferred position for the doctor blade shower is on the return side of the roll with respect to the direction of travel of the belt. The doctor blade wipes (contacts the belt facing in the direction of the movement of the belt) or doctors (contacts the belt facing in the direction against the movement of the belt) the belt as it is being conditioned with a chemical solution. In one embodiment, the doctor blade shower doses a chemical agent in a continuous manner onto the belt.

The apparatus can also include one or more high pressure chemical showers directed towards the face side of the belt. The high pressure shower can be an oscillating or scanning type shower, which runs continuously or semi-continuously spraying a combination of chemical solution and water. Various drying devices, such as a vacuum box or a "table roll" with doctor can be positioned after the last shower to remove at least some of the water applied by the shower to the belt.

An additional shower can also be provided that sprays a second chemical solution for the purpose of removing residual chemicals left on the belt via the conditioning chemicals. One preferred position for such spray is downstream from the other chemical sprayers. It should be appreciated however that multiple "rinse" type showers can be placed along the belt. A doctor blade can also be provided at the return end of the apparatus. In one embodiment, a backing roll is placed behind the doctor blade on the backside of the transfer belt to provide sufficient support for the blade in removing excess water from the surface of the belt before the belt is re-mated with the fibrous web.

It should be appreciated that while the conditioning occurs on the face-side of the belt in the embodiments illustrated below, the present invention is not limited to only conditioning the face-side of the belt and, where applicable, can instead condition the backside of a belt having a water impermeable surface. One such application is described above where the backside of a belt is polymer coated to reduce friction caused by a shoe of a press nip.

It is therefore an advantage of the present invention to provide an improved paper machine.

It is another advantage of the present invention to provide a conditioning method and apparatus therefore, which is operable to clean a water impermeable surface of a paper machine belt and/or prevent deposits from accumulating on the surface.

It is a further advantage of the present invention to position conditioning apparatuses at optimal positions for conditioning a water impermeable surface of a paper machine belt.

It is yet another advantage of the present invention to provide supports against which the conditioning apparatuses are positioned to increase performance of such apparatuses.

It is yet a further advantage of the present invention to provide chemical solutions formulated to clean deposits from a water impermeable belt.

It is still another advantage of the present invention to provide chemical solutions formulated to prevent deposits from accumulating on a water impermeable belt.

It is still a further advantage of the present invention to provide chemical solutions formulated to rinse residual chemicals from the water impermeable belt.

Additional features and advantages of the present invention are described in, and will be apparent from, the following Detailed Description of the Invention and the figures.

DETAILED DESCRIPTION OF THE INVENTION

Figure 1:
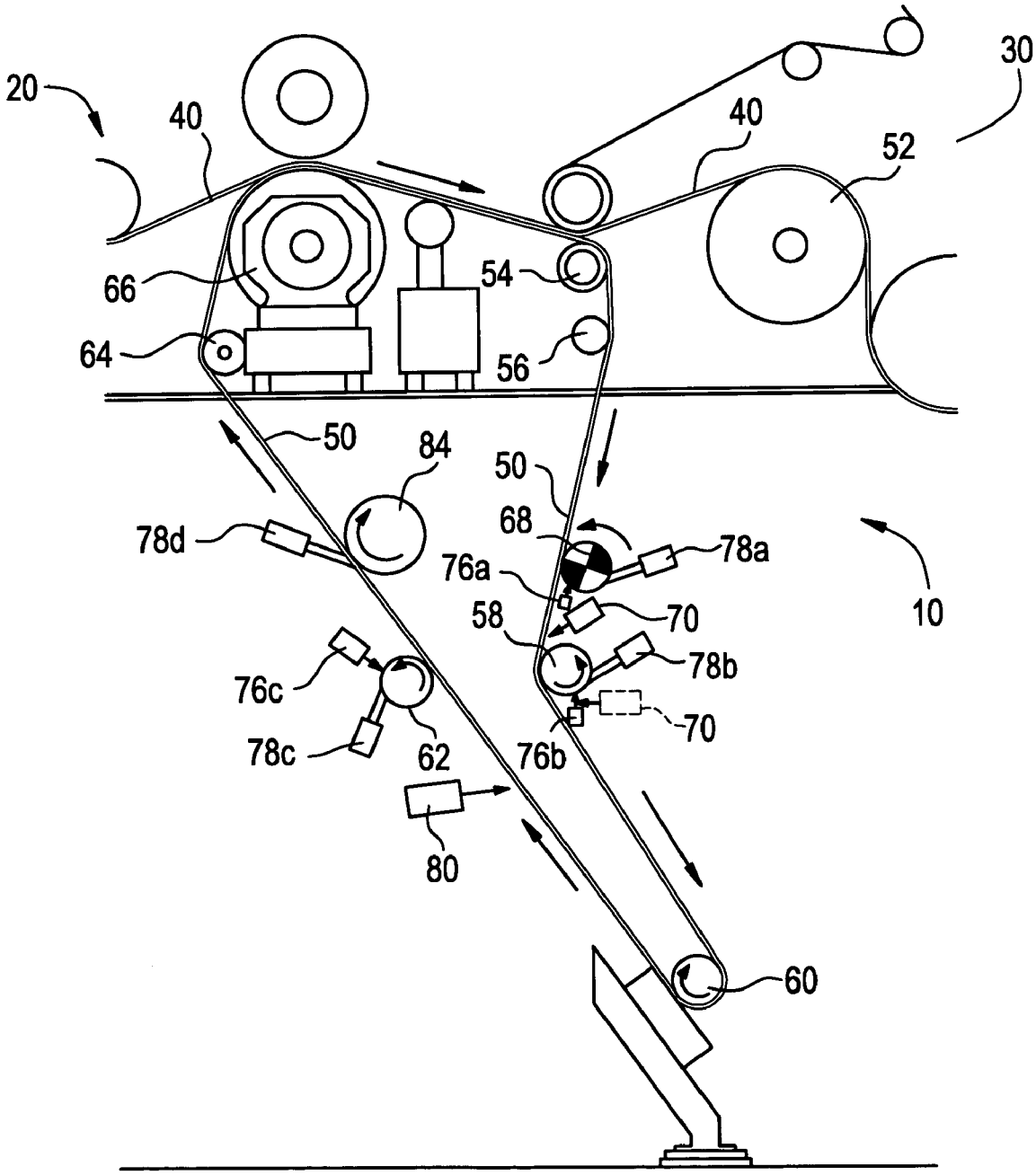
FIG. 1 is an elevation view of one embodiment of a paper machine and belt conditioning apparatus of the present invention.

Referring now to the drawings and in particular to FIG. 1, a paper machine 10 according to the present invention is illustrated. Paper machine 10 is operable to produce a variety of different types of paper products, such as many different grades of paper (including but not limited to all grades of paper, paper towels, toilet paper, napkins and facial tissue) and paperboard (including but not limited to all grades of cardboard and construction board). Machine 10 can operate any type of paper making process including but not limited to press section press operations, size press operations and coater operations.

Machine 10 in one embodiment includes a press section 20 and a dryer section 30. As discussed above, press section 20 includes a number of press nip rolls that mechanically press water or moisture from a web 40, which includes cellulosic fibers and a press fabric. Dryer section 30 includes cylinders, which can be steam heated drying cylinders that evaporate water from the web to further dry same.

Web 40 in the illustrated embodiment is transferred as a closed draw from press section 20 to dryer section 30. The closed draw web 40 employs a transfer belt 50. To overcome rewetting problems associated with the high pressure nip rolls employed in press section 30, which can transfer water from standard press felts back onto (rewetting) web 40, transfer belt 50 is coated with a water impermeable outer surface. The water impermeable coating can be made of any suitable material that does not absorb water, such as polymers, rubber materials and composite materials. One suitable transfer belt for the present invention is the TransBelt® belt discussed above.

It should be appreciated that while a closed draw machine is one known example of a device using water impermeable belts, the present invention does not require the machine to be a closed draw machine and is instead applicable to any type of machine employing a water impermeable belt. Further, the present invention is not limited to transfer belts and is applicable instead to any paper machine belt having one or more water impermeable surfaces.

Transfer belt 50 in one embodiment tends to adhere to web 40 until the web is pulled away from belt 50 by roll 52. In the time that belt 50 and web 40 are adhered to one another, contaminants from the web can be deposited onto belt 50 and remain thereafter on the web as it is pulled away from the belt. Running the belt and web together through a press roll can increase the amount of deposits. Over time, the deposits can accumulate to the point that belt 50 affects the adherence between the belt and web and potentially the smoothness of the resulting paper product.

As seen in FIG. 1, after web 40 is pulled away from belt 50, belt 50 is pulled vertically downward over rolls 54 and 56 and then angles slightly to mate with a face-side roll 58. Afterwards, belt 50 makes a sharp loop around tensioning roll 60 and begins to return upwards towards web 40. Along the return towards web 40, belt 50 contacts face-side roll 62 before being directed around roll 64 to roll 66, where belt 50 is mated again with web 40.

For a number of reasons, it is believed that face-side rolls 58 and 62 provide optimal places to introduce conditioning chemicals onto belt 50. For one reason, rolls 58 and 62 help the chemicals to contact and cover belt 50 as much as possible. Second, rolls 58 and 62 may themselves be a source of deposits and introducing the chemicals at the rolls may help to reduce the amount of deposits transferred from the rolls to belt 50. It is therefore desirable to place at least one chemical solution spraying shower proximate to, directly at and/or directly on rolls 58 and 62. In various embodiments, one or both the upstream and downstream sides of each roll 58 and 62 is conditioned. The terms "conditioned" or "conditioning" as used herein include either one or both the functions of cleaning deposits from belt 50 as well as preventing deposits from accumulating on belt 50.

Rolls 58 and 62 can be pre-existing rolls of machine 10, where the apparatus of the present invention is retrofitted onto an existing machine. In such a case, the apparatus of the present invention can include the addition of at least one driven or undriven roll, doctor blade or other type of friction causing device at the face-side of the belt to provide additional conditioning and/or desirable locations for the introduction of chemicals. The present invention is expressly not limited to retrofitted paper machines however and is applicable additionally to new paper machines having the disclosed apparatus.

In one embodiment, a face-side driven roll 68, which can be but is not limited to a driven felt roll, is fixed to machine 10 via any suitable fasteners as an initial conditioning apparatus. Face-side driven roll 68 is intended to remove larger and looser particles from belt 50. The positioning of driven roll 68 is chosen to maximize the amount of mechanical cleaning or conditioning that can be accomplished to lessen the reliance on chemical cleaning or conditioning as much as possible. Because belt 50 is smooth and impermeable, the fear of driving fibers or other materials from driven roll 68 into belt 50 is not a factor. To that end, driven roll 68 can be electrically or pneumatically driven at any desirable speed (slower or faster) and direction relative to the speed and direction of belt 50 to create a desired amount and type of surface contact friction.

Driven roll 68 can be equipped with its own conditioning devices. For example, driven roll 68 can be supplied with and thus conditioned by a doctor blade **78*a* and/or doctor shower 76*a*, through which can be dosed a chemical agent in a continuous or semi-continuous manner to assist in removing deposits from the roll's surface. Conditioning devices 76*a* and 78*a* are attached to machine 10 via any of the apparatuses described below. The chemicals used with doctor blade showers 76 (collectively referring to showers 76*a* to 76*c***) can be any of the following chemicals, derivatives or combinations thereof: any known roll release chemicals including low molecular weight polyamines; low molecular weight polyamines in combination with nonionic surfactants, such as ethoxylated alcohol and/or cationic surfactants, such as quaternary ammonium compounds; aliphatic organic solvents, such as kerosene, iso-paraffins, mineral oil, and the like, optionally in combination with nonionic surfactants including silicone-based surfactants and/or anionic surfactants, such as phosphate esters and fatty acid salts; and dispersants, such as naphthalene-formaldehyde condensates, naphthanlene sulfonates and alkanolamides. Suitable chemicals are known in the art and are available from various suppliers including Nalco Company, Naperville, Ill.

After belt 50 passes driven roll 68, the belt runs to and contacts face-side roll 58. A chemical shower 70 is positioned on the face-side of the transfer belt with the spray directed optimally into the interface or nip between belt 50 and face-side roll 58. Chemical shower 70 in one embodiment is fastened to the frame of machine 10 and can be fastened so that it follows any movement of face-side roll 58. Chemical shower 70 provides a more effective doctoring solution than water alone. A second chemical shower 70, shown in phantom, may additionally be placed adjacent to the return side of the interface or nip.

It should be appreciated that any of the showers at any of the locations described herein can spray only water, only chemical(s) or a combination of water and chemical(s). Preferably, at least one of the showers sprays either only chemical(s) or a combination of water and chemical(s). Further, any of the showers at any of the locations described herein can be relatively low pressure or relatively high pressure as desired. Still further, any of the showers at any of the locations described herein can be oscillating or non-oscillating. Moreover, the present invention is not limited to only providing showers at the locations shown in the drawings and can include more or less showers at the same or different locations as desired. The drawings do however show one suitable and preferred embodiment.

Chemical shower 70 is alternatively or additionally directed onto roll 58. In one embodiment, shower 70 is an oscillating fan shower, which includes multiple sprayers extending from a pipe manifold. The manifold oscillates or traverses back and forth along the face side of belt 50 to ensure that the chemical is sprayed evenly over the entire width of the belt. The manifold also oscillates to increase coverage along the face side of transfer belt 50.

The chemical nozzles spray a jet of chemicals, which clean and adhere to the impermeable surface of belt 50 as it passes face-side roll 58 supporting the belt. Chemical shower 70 is movably fastened to a support beam or similar structure of machine 10, which extends at or near belt 50, and which can be attached to the sub-frame holding roll 58 enabling shower 70 to follow any movement of roll 58. Chemical shower 70 is installed in one embodiment 4 to 6 inches (10 to 15 cm) from the sprayed surface and operated between pressures of about 5 to about 350 psig.

The chemical spray nozzles of shower 70 can be positioned to direct a spray substantially perpendicularly to belt 50 and/or roll 58. Alternatively, the nozzles of shower 70 can be rotated, shifted or otherwise set at any desired impact angle with respect to the water impermeable surface of belt 50 and/or roll 58. That is, the chemical spray can be made directly at the surface of belt 50 or at some tangential angle with respect to same. For example, shower 70 can be an oscillating shower with 15° fan nozzles. The fan nozzles spray chemicals onto the belt, coating the belt while also removing deposits from the face of belt 50.

The chemicals moving through the spray nozzles keep the nozzles clean and open, which helps to provide uniform coverage of the chemicals along the face side of belt 50. The frequency of oscillation of the shower 70 can be matched with and varied automatically with the belt speed in an additional effort to provide uniform spray coverage.

Chemical shower 70 displaces contaminants and deposits from the impermeable surface of belt 50. The shower can be operated intermittently or continuously while belt 50 runs continuously. In more difficult conditioning applications, such as those from an operation having a high amount of recycled fiber, a brush (rotating or stationary) or doctor (not illustrated) can be provided in combination with chemical shower 70. If a brush is used, the brush can itself be conditioned in a similar manner described above in connection with face-side driven roll 68.

Figure 2:
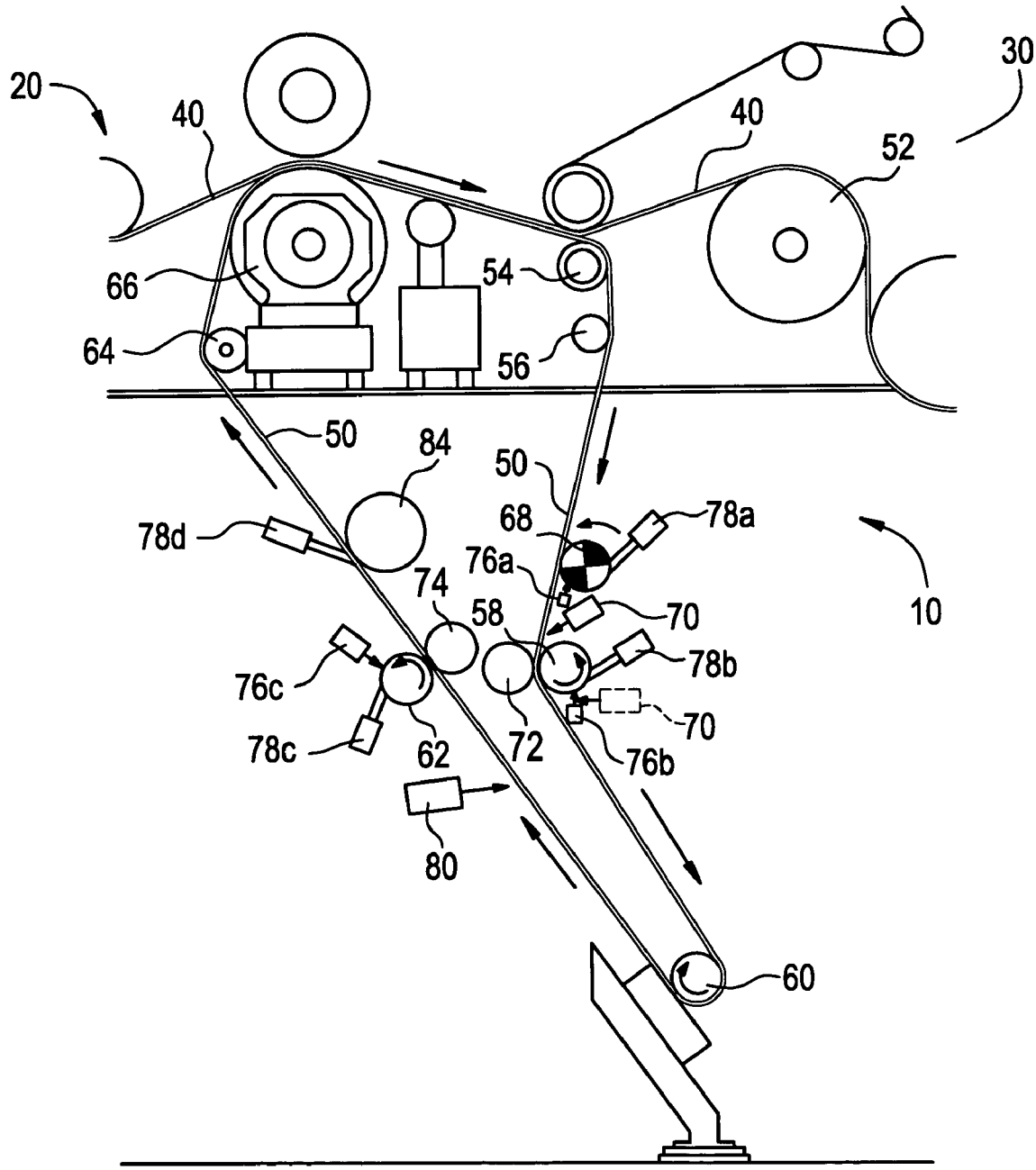
FIG. 2 is an elevation view of another embodiment of a paper machine and belt conditioning apparatus of the present invention.

FIG. 2 illustrates an alternative embodiment where a backing roll 72 is placed behind face-side roll 58 to create or enhance a press nip between roll 72 and roll 58. Such configuration increases the pressure at which chemicals from shower 70 contact belt 50 and may increase the coverage and effectiveness of the chemicals. As before, backing roll 72 can be retrofitted to existing machines or provided with new paper machines and can be driven (in any desired direction) or not driven. FIG. 2 also illustrates that a second backing roll 74 is provided to create or enhance a press nip with face-side roll 62. The present invention includes any combination of providing no backing rolls, providing some backing rolls or pairing each face-side roll with a backing roll.

The chemical solution applied by shower 70 and indeed by each of the fan showers and high pressure jet showers discussed herein can comprise a neutral-, acid- or alkaline-based formulation. The formulations for the different showers can be the same or different. The formulations can include, but are not limited to, any of the following chemicals, derivatives or combination thereof: cleaning chemicals, such as anionic, nonionic and amphoteric surfactants; solvents including glycol ethers, D-limonene, low molecular weight alcohols; aliphatic or aromatic hydrocarbon solvents; acid-based cleaners including mineral acids (hydrochloric acid, sulfuric acid), organic acids (citric acid, glycolic acid), alkyl sulfonic acids; corrosion inhibitors including filming amines and chelators (EDTA, DPTA); alkaline cleaners including hydroxides, silicates and inorganic phosphates, and the like. Suitable chemical formulations are known in the art and are available from various suppliers including Nalco Company, Naperville, Ill.

Doctor showers 76, e.g., showers 76*b* and 76*c*, which can be an oscillating fan showers, are attached in any of the manners described above on each of the face-side rolls 58 and 62 that contact the belt 50, in one embodiment. Alternatively, a shower 76 may not used with each one of the rolls 58 or 62. Showers 76 can be low or high pressure showers. In one preferred embodiment, showers 76*b* and 76*c* are positioned in front of associated doctor blades 78 with respect to the angular direction of travel of belt 50. Any of the chemicals described above are dosed through shower 76 in a continuous or semi-continuous manner to further clean and/or prevent contaminant build-up on the belt 50 and on the rolls 58 and 62.

Showers 76 in one embodiment sprays chemicals onto belt 50 and rolls 58, 62 to suspend contaminants transferred from the belt 50 onto those rolls. The suspended contaminants are more easily removed by the doctor blades 78 (collectively referring to blades 78*a* to 78*d*), which in one embodiment contact rolls 58, 62 in the positions and at the angles illustrated. Alternatively or additionally, one or more additional doctor blade 78, e.g., doctor blade 78*d*, is provided to contact belt 50 to mechanically remove deposits from the belt.

In the illustrated embodiments, doctor blade showers 76*a* to 76*c* are positioned at suitable circumferential positions and contact angles with respect to rolls 68, 58 and 62, respectively. Other suitable circumferential positions and contact angles are possible. As seen, for each roll 68, 58 and 62, doctor blade showers 76*a* to 76*c* are placed in front of the associated doctor blades 78*a* to 78*c* with respect to the rotational direction of travel of the rolls shown by the associated arrows. In this manner, a chemical film provided by showers 76*a* to 76*c* lubricates the contact between doctor blades 78*a* to 78*c* and rolls 68, 58 and 62, respectively. The chemicals tend to suspend the deposits on the rolls to facilitate improved removal of same via doctor blades 78*a* to 78*c*.

In the illustrated embodiments, doctor blades 78*a* to 78*d* are positioned at suitable circumferential positions and contact angles with respect to rolls 68, 58 and 62, respectively. Other suitable circumferential positions and contact angles are possible. As seen, for each roll 68, 58 and 62, doctor blades 78*a* to 78*c* are respectively placed at least somewhat tangentially against the rolls and extend against the direction of rotation of the rolls as seen by the rotational arrows. Alternatively, blades 78*a* to 78*c* extend in the same direction as the direction of the rotation of the rolls.

An oscillating or scanning, face-side high-pressure shower 80 is attached in any of the manners described above on the return up-run of belt 50 to roll 62. In one preferred embodiment, high pressure shower 80 is operated continuously with water, chemical or a chemical/water mixture to pressure condition belt 50. In one preferred embodiment, only water is used with high pressure shower 80. The high pressure spray, as illustrated, is in one embodiment directed at the belt at a desired angle. Alternatively or additionally, the spray is directed into the interface between belt 50 and a roll, such as roll 62.

In one embodiment, high pressure shower 80 is mounted approximately 6 inches (15 cm) from the sprayed surface and operated at pressures from about 150 psig and up. The pressure of water and/or liquid chemicals exiting the nozzles of high pressure shower 80 is kept below a level that could damage the water impermeable belt 50, although pressure is not as much of a concern as it is with felt or fabric conditioning. High pressure shower 80 oscillates in one embodiment as described above and includes high pressure nozzles, which can be oriented in any direction in relation to the water impermeable surface of belt 50 and/or roll 62 as described above.

High pressure shower 80 can be coupled with any suitable device (not illustrated) for removing excess water and chemicals from belt 50, such as a "table roll" doctor or a suctioning device, such as a canted vacuum box. The suctioning device is used to dewater the belt and to further clean the belt by applying a uniform vacuum across the belt to suction deposits off of same.

As discussed above in connection with FIG. 2, roll 62 is alternatively operable as a press nip with backing roll 74. Doctor shower 76*c* and doctor blade 78*c* and/or roll 74 can be mounted to follow any movement of roll 62. Doctor shower 76*c* operates in the same or similar manner as shower 76*b* to produce the same or similar results. A chemical shower 70 (not illustrated) can be provided with roll 62, e.g., at one or both interfaces between belt 50 and roll 62 if needed.

In the illustrated embodiment, a face-side doctor blade 78*d* is attached in any of the manners described above after showers 70 and 80. As illustrated, blade 78*d* extends against the direction of travel of belt 50, although it could extend with the direction of travel. A backing roll 84 is attached to the frame of machine 10 on the backside of belt 50 to provide sufficient support against which blade 78*d* can press to remove excess water and remaining deposits from the surface of the belt. Backing roll 84 may or may not be driven in any desired direction. Any undriven internal rolls (e.g., if rolls 72, 74 and 84 are not driven) are rotated by the belt in the direction caused by the tangential contact of belt 50 traveling in the direction shown by the linear arrows.

Although one preferred position for doctor blade 78*d* is on the return side or after each of the sprayers, one or more doctor blade, such as blade 78*d*, can be positioned alternatively or additionally in any suitable part of the loop created by belt 50. Moreover, the showers 70 and 80 described above can be placed in any suitable part of the loop created by belt 50 and are not limited to being placed in cooperation with a face-side rolls, such as rolls 58 and 62.

In one embodiment, the chemicals sprayed through doctor blade showers 76*a* to 76*c* after or on the return side of roll 62 are formulated to lubricate belt 50 for its upcoming contact with doctor blade 78*d* and to coat belt 50 so that the belt is less susceptible to accumulating deposits when it remates with web 40. Thus, in one embodiment the chemicals are selected to: (i) clean belt 50 (via e.g., showers 70 and 80); (ii) remove residual conditioning chemical residue from belt 50 (via e.g., shower 80); and (iii) coat belt 50 (e.g., via shower 76*c*) before belt 50 remates with web 40.

While each of the showers and conditioning devices has been positioned on the face-side of belt 50 in the embodiments illustrated herein, the showers and devices can also be positioned on the backside of belt 50, if needed. The backside of belt 50 may also have a water impermeable surface for reasons described above. If the accumulation of deposits on the backside of the belt presents operational problems, the deposits can be removed chemically via the methods and apparatus described herein.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A belt conditioning apparatus for a press section prior to a dryer section of a papermaking process for a continuous belt having a water impermeable surface and a face-side roll that contacts the water impermeable surface, the apparatus comprising: a chemical shower placed proximate to the face-side roll in the press section prior to a dryer section of a papermaking process and on the same side of the face-side roll, the shower operable to spray either one or more types of conditioning chemicals, water, or a combination thereof on the water impermeable surface of the continuous belt or the face-side roll.

2. The belt conditioning apparatus of claim 1, wherein the chemical is based on a neutral, acidic or alkaline formula.

3. The belt conditioning apparatus of claim 1, wherein the chemical is selected from the group consisting of: (i) anionic, nonionic and amphoteric surfactants; (ii) solvents including glycol ethers, D-limonene and low molecular weight alcohols; (iii) aliphatic and aromatic hydrocarbon solvents; (iv) acid-based cleaners including mineral acids, hydrochloric acid, sulfuric acid, organic acids, citric acid, glycolic acid and alkyl sulfonic acids; (v) corrosion inhibitors including filming amines and chelators; (vi) alkaline cleaners including hydroxides, silicates and inorganic phosphates; and (vii) any combination or derivative thereof.

4. The belt conditioning apparatus of claim 1, wherein the shower is an oscillating shower, a doctor blade shower, a high pressure shower or any combination thereof.

5. The belt conditioning apparatus of claim 1, wherein the shower operates additionally with water, and which includes a doctor blade positioned operably relative to the high pressure shower.

6. The belt conditioning apparatus of claim 5, which includes a backing roll placed on the backside of the belt, the backing rail operable to provide an adequate counteracting force against the doctor blade.

7. The belt conditioning apparatus of claim 1, wherein the shower is placed directly before or directly after the face-side roll with respect to the direction of travel of the belt.

8. The belt conditioning apparatus of claim 1, wherein the shower is a first shower placed before the face-side roll and which includes a second shower placed after the face-side roll with respect to a direction of travel of the belt.

9. The belt conditioning apparatus of claim 8, wherein the second shower sprays: (i) the same conditioning chemical; (ii) a different conditioning chemical; or (iii) water onto the water impermeable surface.

10. The belt conditioning apparatus of claim 1, wherein the face-side roll is a first face-side roll and the shower is a first shower, wherein the belt is contacted by a second face-side roll, and which includes a second shower placed proximate to the second face-side roll.

11. The belt conditioning apparatus of claim 10, wherein the second shower sprays: (i) the same conditioning chemical; (ii) a different conditioning chemical; or (iii) water onto the water impermeable surface.

12. The belt conditioning apparatus of claim 1, which includes a face-side driven roll positioned against the water impermeable surface.

13. The belt conditioning apparatus of claim 12, wherein the face-side driven roll includes at least one feature selected from the group consisting of: (i) being positioned before the face-side roll; (ii) being driven at a different speed than the belt; and (iii) being conditioned with at least one of a doctor blade and a chemical shower.

14. The belt conditioning apparatus of claim 12, wherein the face-side driven roll is conditioned with a chemical selected from the group consisting of: (i) low molecular weight polyamines; (ii) low molecular weight polyamines in combination with nonionic surfactants including ethoxylated alcohols and cationic surfactants and quaternary ammonium compounds; (iii) aliphatic organic solvents including kerosene, iso-paraffins and mineral oil; (iv) organic solvents in combination with nonionic surfactants including silicone-based surfactants and anionic surfactants including phosphate esters and fatty acid salts; (v) dispersants including naphthalene-formaldehyde condensates, naphthanlene sulfonates and alkanolamides; and (vi) any combination or derivative thereof.

15. The belt conditioning apparatus of claim 1, which includes a backing roll placed on an opposite side of the belt from the face-side roll, the backing roll creating a press nip with the face-side roll.

16. The belt conditioning apparatus of claim 1, which includes a doctor blade positioned against the impermeable surface of the belt and a backing roll operable to provide an adequate counteracting force against the doctor blade.

17. A paper machine comprising: a press section operable to mechanically press moisture from a fibrous web; a dryer section operable to evaporate moisture from the web; a continuous belt that passes through the press section prior to a dryer section, the belt having a water impermeable surface, a face-side roll in the press section that contacts said water-impermeable surface; and a chemical shower placed proximate to the face-side roll in the press section and on the same side of the face-side roll, the shower operable to spray either one or more types of conditioning chemicals, water, or a combination thereof on the water impermeable surface or the face-side roll.

18. The paper machine of claim 17, wherein the fibrous web is of a type selected from the group consisting of; a paper web and a paperboard web.

19. The paper machine of claim 17, wherein the water impermeable surface is located on a face-side of the belt or on a backside of the belt.

20. The paper machine of claim 17, which includes a face-side roll that contacts the water impermeable surface, and wherein the shower is located directly before, adjacent to or directly after the face-side roll with respect to a direction of travel of the belt.

21. The paper machine of claim 17, wherein the chemical is selected from the group consisting of: (i) anionic, nonionic and amphoteric surfactants; (ii) solvents including glycol ethers, D-limonene and low molecular weight alcohols; (iii) aliphatic and aromatic hydrocarbon solvents; (iv) acid-based cleaners including mineral acids, hydrochloric acid, sulfuric acid, organic acids, citric acid, glycolic acid and alkyl sulfonic acids; (v) corrosion inhibitors including filming amines and chelators (EDTA, DPTA); (vi) alkaline cleaners including hydroxides, silicates and inorganic phosphates; and (vii) any combination or derivative thereof.

22. The paper machine of claim 17, wherein the belt is operable to transfer the web from the press section to the dryer section.

* * * * *